US005933990A

United States Patent [19]

Keyser et al.

[11] Patent Number: 5,933,990

[45] **Date of Patent: *Aug. 10, 1999**

[54] ROTATABLE SIGN

[76] Inventors: William W. Keyser, 9112 S. Ridgeway; David B. Keyser, 9152 S. Central Park, both of Evergreen Park, Ill. 60642

[ * ] Notice: This patent issued on a continued prosecution application filed under 37 CFR 1.53(d), and is subject to the twenty year patent term provisions of 35 U.S.C. 154(a)(2).

[21] Appl. No.: 08/647,275

[22] Filed: May 13, 1996

Related U.S. Application Data

[63] Continuation of application No. 08/254,262, Jun. 6, 1994, abandoned.

[51] Int. Cl.[6] ..... G09F 11/12

[52] U.S. Cl. ..... 40/472; 40/524

[58] Field of Search ..... 40/470, 472, 525, 40/524, 526, 528; 362/812

[56] References Cited

U.S. PATENT DOCUMENTS

| | | | |
|---|---|---|---|
| 302,723 | 7/1884 | Grimes . | |
| 449,464 | 3/1891 | Cook . | |
| 574,815 | 1/1897 | McCelland . | |
| 690,934 | 1/1902 | Dick . | |
| 786,610 | 4/1905 | Terry . | |
| 843,889 | 2/1907 | Gilman et al. . | |
| 853,129 | 5/1907 | Simpson . | |
| 947,828 | 2/1910 | Lennox . | |
| 956,425 | 4/1910 | Rothschild . | |
| 1,008,260 | 11/1911 | Harris . | |
| 1,188,154 | 6/1916 | Cross . | |
| 1,347,012 | 7/1920 | Colony . | |
| 1,355,716 | 10/1920 | Trevail . | |
| 1,402,075 | 1/1922 | Kolk . | |
| 1,523,976 | 1/1925 | Meyer . | |
| 1,686,994 | 10/1928 | Thompson | 40/526 |
| 1,762,685 | 6/1930 | Hartman et al. . | |
| 1,807,649 | 6/1931 | Brown . | |
| 1,812,715 | 6/1931 | Quillin et al. . | |
| 1,825,900 | 10/1931 | England . | |
| 1,847,815 | 3/1932 | Church . | |
| 1,858,208 | 5/1932 | Ingersoll . | |
| 1,973,983 | 9/1934 | Henning . | |
| 2,033,478 | 3/1936 | Martinez . | |
| 2,122,153 | 6/1938 | Page . | |
| 2,160,886 | 6/1939 | McCombs . | |
| 2,204,868 | 6/1940 | Russell et al. . | |
| 2,328,648 | 9/1943 | Jansson . | |

(List continued on next page.)

FOREIGN PATENT DOCUMENTS

| | | | |
|---|---|---|---|
| 581751 | 4/1959 | Canada | 40/472 |
| 445569 | 9/1991 | European Pat. Off. | 40/472 |
| 0509159A1 | 10/1992 | European Pat. Off. . | |
| 571629 | 2/1924 | France . | |
| 2382729 | 11/1978 | France | 40/472 |
| 558336 | 9/1932 | Germany . | |
| 2044028 | 4/1971 | Germany . | |
| 1467 | 9/1916 | Netherlands . | |
| 357544 | 9/1931 | United Kingdom | 40/472 |
| 2052124 | 1/1981 | United Kingdom . | |

OTHER PUBLICATIONS

Jackson & Moreland. *Design Manual for Roller and Silent Chain Drives.* U.S.A.: 1958.

Faulkner, L.L., S.B. Menkes et al. *Chains for Power Transmission and Material Handling, Design and Applications Handbook.* New York: Marcel Dekker, Inc., 1982.

*Primary Examiner*—Peter M. Cuomo
*Assistant Examiner*—James O. Hansen
*Attorney, Agent, or Firm*—Hill & Simpson

[57] ABSTRACT

A rotatable sign with a plurality of routinely alterable display faces is disclosed, having at least two endless roller chains, a plurality of mounting clips and bi-ended slats, and a plurality of interchangeable message strips and flexible sheets that may be mounted on the sign assembly using the slats and clips, where portions of the message strips may be altered using self-stick adhesive patches.

7 Claims, 7 Drawing Sheets

U.S. PATENT DOCUMENTS

| | | | |
|---|---|---|---|
| 2,519,299 | 8/1950 | Vanderzee . | |
| 2,541,632 | 2/1951 | Baugh . | |
| 2,649,797 | 8/1953 | O'Gorman . | |
| 2,649,798 | 8/1953 | Bustamante . | |
| 2,847,782 | 8/1958 | Muse . | |
| 3,175,318 | 3/1965 | Bayer | 40/524 X |
| 3,348,038 | 10/1967 | Jacobs . | |
| 3,349,738 | 10/1967 | Kish, Jr. . | |
| 3,395,472 | 8/1968 | Look . | |
| 3,479,985 | 11/1969 | Morley . | |
| 3,595,380 | 7/1971 | Miller . | |
| 3,616,556 | 11/1971 | Williams . | |
| 3,680,927 | 8/1972 | Neureuther . | |
| 3,780,458 | 12/1973 | Jacoby et al. . | |
| 3,919,794 | 11/1975 | Hunter, Jr. | 40/470 |
| 3,961,434 | 6/1976 | Sampon . | |
| 4,047,314 | 9/1977 | Slack et al. . | |
| 4,201,002 | 5/1980 | Barton . | |
| 4,237,635 | 12/1980 | Paraghamian et al. | 40/472 X |
| 4,253,171 | 2/1981 | Grinwald . | |
| 4,333,255 | 6/1982 | Ward . | |
| 4,367,604 | 1/1983 | Porter, II et al. . | |
| 4,542,605 | 9/1985 | Gandy . | |
| 4,626,046 | 12/1986 | Collins, Jr. . | |
| 4,669,156 | 6/1987 | Guido et al. . | |
| 4,707,938 | 11/1987 | Carssow . | |
| 4,718,543 | 1/1988 | Leisner et al. . | |
| 4,827,644 | 5/1989 | Trame . | |
| 4,868,956 | 9/1989 | Shepherd . | |
| 5,009,258 | 4/1991 | Fraser . | |
| 5,022,172 | 6/1991 | Kawahara et al. | 40/475 X |
| 5,138,781 | 8/1992 | Claver . | |

VI
VII
VIII
51
50
49
52
53
54
55
56
57
58
59
60
61
62
63
64
65
66
68
69
70
71
72
80
30

ROTATABLE SIGN

This application is a continuation of application Ser. No. 08/254,262 filed Jun. 6, 1994, now abandoned.

FIELD OF THE INVENTION

This invention relates to a rotatable sign for displaying interchangeable messages and pictures, and more particularly, to an endless roller chain and slat assembly consisting at least of parallel, transverse slats that are removably attached to roller chains, where flexible message strips and picture sheets are insertable between the slats, and may be additionally supported by mounting clips attached at one end to a roller chain.

BACKGROUND OF THE INVENTION

During the past century, many rotatable display devices have been developed for various purposes, for example, advertising, sales presentations, education, display of juke box song titles, and record keeping. For some devices, continuous movement and animation were desirable. This was usually accomplished with some degree of success by means of an endless belt, lights or reflectors, and a motor. For other devices, portability was key. For still others, durability was an issue because the display was outdoors, or because members of the public were routinely rotating the device, as with a jukebox song title display mechanism located at a bar or restaurant.

None of these prior art devices, however, particularly suited the needs of the fast food industry, which is catering increasingly to drive-through customers eager to read full menu listings on outdoor menu boards. The industry needs an expedient and routine way to switch among displayed breakfast, lunch and dinner menus; a way to include photographs or illustrations of menu items as part of the menu display if desired; a fast and routine way to change individual menu items and individual illustrations or photographs of selected menu items; and a fast and routine way to change the price of an individual menu item without reprinting the full menu item description.

The ability to change prices has been addressed in the past by use of rotatable tapes containing digits zero through nine. As many of these tapes as necessary could be arranged on a carrier device so that one predetermined digit at a time, per tape, would show through an appropriate opening in the material inscribed with a menu item description. The tape or tapes could be periodically pulled, twisted or rotated in order to change the displayed digit(s), and thus the price of the item. These tapes present unique difficulties when used in outdoor signs because vibrations from passing cars and trucks tend to advance the tapes and change the displayed price.

It is thus an object of the present invention to provide a relatively large, durable, rotatable sign, that may be operated outdoors, is easy to maintain, is economical to manufacture, is capable of displaying any one of several available menus, and is capable of expediently switching among the available menus.

A related object of the present invention is to provide menus, for display by a rotatable sign, that include relatively narrow descriptive message strips, or relatively large pictures, or some combination of both, where the strips and pictures are removably but securely mounted on inexpensive, reliable, rugged roller chains.

Another object is to provide a rotatable sign in which any one message strip may be easily and routinely exchanged for another message strip, and where any two or more message strips may be easily and routinely exchanged for one or more pictures.

Still another object is to provide a series of rib-shaped transverse mounting slats that easily and securely attach at each end to a roller chain, that just as easily detach from the roller chains, that are designed so that one message strip may be removably inserted between two parallel slats, and will be securely and reliably supported therein, and that are further designed so that a picture may be removably inserted between, and will be partially supported by, two parallel spaced slats.

Yet another object is to provide a mounting clip that easily and securely attaches to a roller chain, that just as easily detaches from the roller chain, and that is designed to be used with other like clips to detachably receive and support a picture at the picture's vertical edges in a rotatable sign assembly.

Yet another object is to provide an attractive message strip that has a price display where the price display may be easily and routinely changed by means of a self-stick adhesive material.

Other objects and advantages of the invention will be apparent from the accompanying description, drawings and claims. Throughout the drawings, like reference numerals refer to like parts.

SUMMARY OF THE INVENTION

In accordance with the present invention, the foregoing objects are achieved by provision of a rotatable sign assembly having at least two endless roller chains, a plurality of mounting clips and bi-ended slats, and a plurality of interchangeable message strips and flexible sheets that may be mounted on the sign assembly using the slats and clips. The message strips and flexible sheets display information, including letters, words, numbers and pictures.

The slats have two grooved edges, and are arranged in parallel relationship. Each end of each slat is removably connected to one of the chains so that the grooved edges are perpendicular to the chains, and the slats are not connected to one another except by the chains. The mounting clips each have an end and a sheet-retaining edge, and each end is removably connected to one of the chains. Both the slats and the clips have elbows to position them in a predetermined manner with respect to the chains.

A flexible sheet may be removably inserted, at its two edges that are perpendicular to the chains, between the grooved edge of one slat, and the confronting grooved edge of a second parallel slat. At its two edges that are parallel to the chains, the flexible sheet may be removably inserted into the sheet-retaining edges of at least two mounting clips, where one of the mounting clips is attached to one of the roller chains, and the second mounting clip is attached to the second roller chain.

Message strips may be removably inserted between two slats, since each slat has top and bottom grooved edges for engaging such message strips, or alternatively for engaging the top and bottom edges of flexible sheets.

Several slats may be easily removed and replaced with an equal number of pairs of mounting clips without affecting the operation of the endless roller chain assembly. Such replacement enables the substitution of a flexible sheet for several message strips where the flexible sheet is several times the length of any one message strip.

Self-stick adhesive patches are provided for frequently changing predetermined characters on the message strips.

DESCRIPTION OF PREFERRED EMBODIMENT

While the invention is disclosed in connection with a preferred embodiment, such disclosure is for purposes of illustration and description only. It is not intended to be exhaustive or to limit the invention to the precise forms disclosed. Many variations and modifications of the embodiments described herein will be obvious to one of ordinary skill in the art in light of this disclosure. The scope of the invention is to be defined by the appended claims and by their equivalents.

Figure 1:
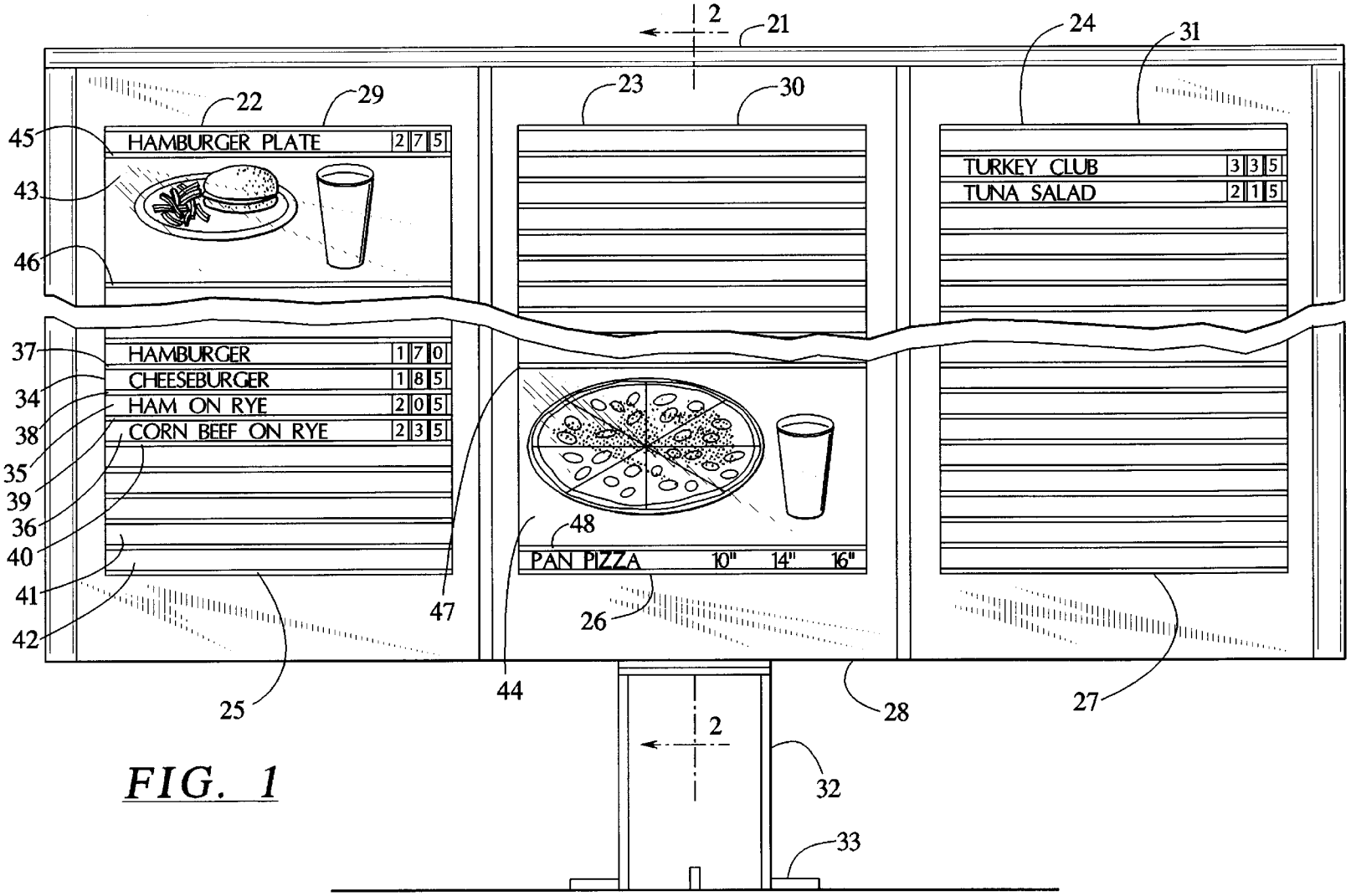
FIG. 1 is a front elevational view of a sign assembly having multiple display faces in accordance with one embodiment of the invention.

FIG. 1 shows the front of the preferred embodiment of the present invention. In order to display menus outdoors, this rotatable sign 21 has three display faces 22, 23 and 24 that may be observed through windows 25, 26 and 27 in the weathertight cabinet 28 that houses the sign 21. Each of the three display faces 22–24 is part of a separate endless roller chain and slat assembly 29, 30, 31 (FIGS. 1 and 3) and displays a portion of a menu having item descriptions, prices and pictures sized large enough to be observed and read by customers seated in an automobile. The sign 21 is mounted on a wide-flange column 32 set in a concrete footing 33 at a height that permits convenient reading by drive-through customers. Each of several individual message strips, e.g., 34, 35, 36, is held in place between two transverse mounting slats 37, 38, 39, 40. The message strips display information, which could consist of letters, numbers, pictures or the like. In the present embodiment, the message strips generally carry a description and price for a particular menu item. Message strips may also be blank, like strips 41, 42 in FIG. 1.

Two flexible sheets 43, 44, which in this embodiment of the invention are point of purchase ("P.O.P.") pictures of menu items, are held in place at their top and bottom edges by slats 45, 46, 47, 48. P.O.P. pictures 43, 44 are held in place intermittently along their vertical edges by mounting clips like those illustrated in FIG. 10. The mounting clips are hidden from view in FIG. 1 by the cabinet 28. Generally, the flexible sheets contemplated in this invention, like the message strips, display information, including letters, numbers, pictures, or nothing at all.

Figures 5, 6, 7, 8:
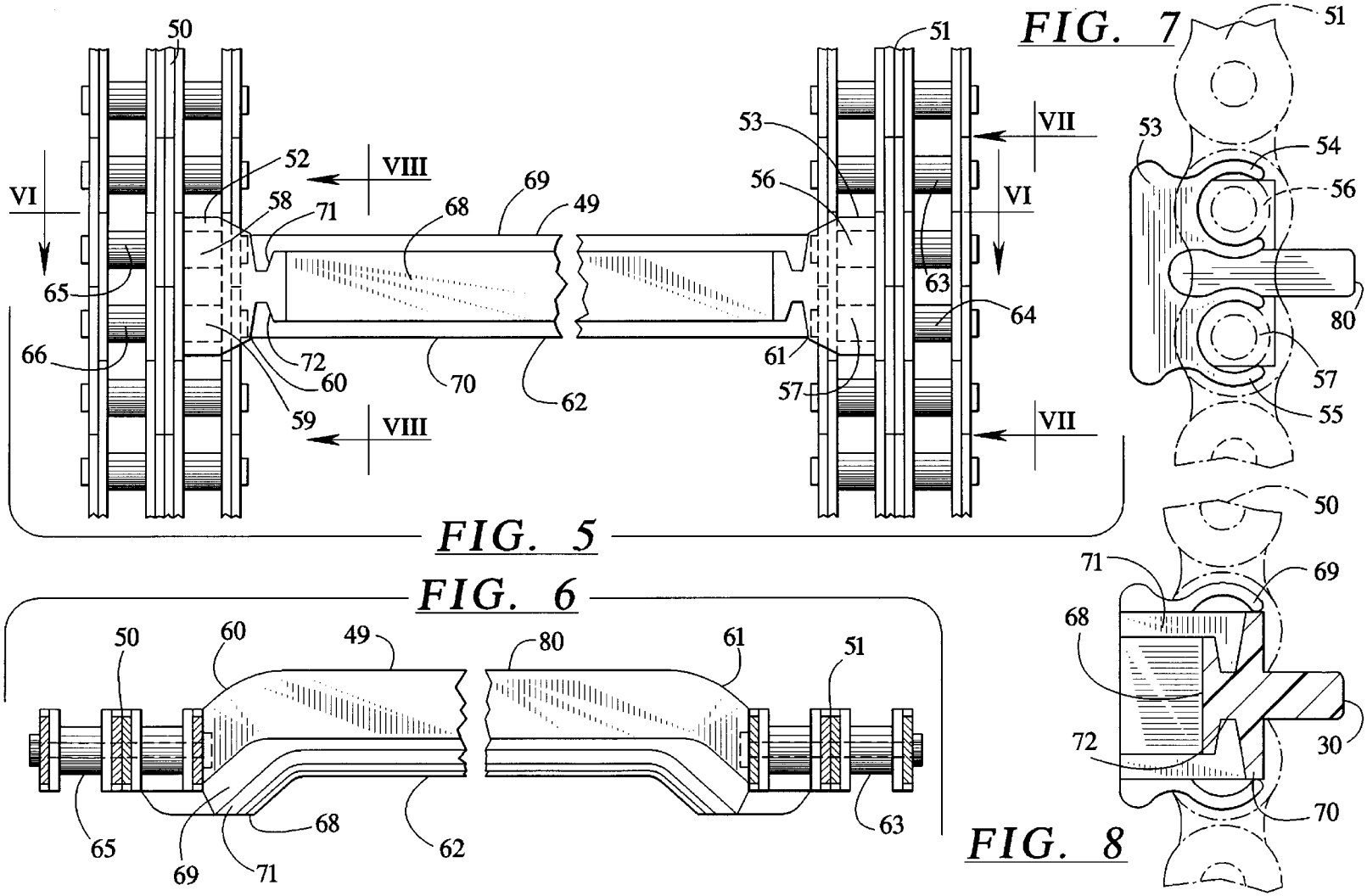
FIG. 5 is an enlarged fragmentary view of the drive chains and suggested in FIG. 3.
FIG. 6 is a sectional view taken substantially in the plane of line 6—6 in FIG. 5.
FIG. 7 is an end view of the slat taken substantially in the plane of line 7—7 of FIG. 5.
FIG. 8 is a sectional view taken substantially in the plane of line 8—8 in FIG. 5.

One primary object of the present invention is to provide transverse mounting slats that readily attach to and detach from roller chains. FIGS. 5–8 provide detailed illustrations of such an innovative transverse bi-ended mounting slat 49. The bi-ended slat 49 of FIG. 5 is removably mounted on double row roller chains 50 and 51 by means of its ends 52, 53. Two slat hooks 54, 55 are disposed at one end 53 of the slat of FIGS. 5–7 to engage two roller chain rollers 56, 57 in the first roller chain 51 that are adjacent to each other in a direction perpendicular to the line of axis of either of the rollers. Two slat hooks identical to slat hooks 54, 55 are disposed at the other end 52 of the slat 49, to engage roller chain rollers 58, 59 in the second roller chain 50, that are adjacent to each other in a direction perpendicular to the line of axis of either of the rollers. Each of the two ends 52, 53 of the slat 49 is attached to an elbow 60, 61 and the elbows each join the slat mid-section 62 as shown in FIGS. 5–6. For ease of manufacture as well as for durability, the slat 49, comprised of its hooks, ends, elbows and a mid-section, is integrally molded, preferably of plastic, e.g., Delron® or Nylons®. The slat 49 may be readily and securely attached to and removed from chains 50, 51 by means of the hooks disposed on its ends, thus achieving one of the main objects of the present invention.

Each engaged roller 56, 57, 58, 59 in the illustrated embodiment of FIGS. 5–7 has an axially adjacent roller chain roller 63, 64, 65 and 66, due to the configuration of the double row roller chains provided. These axially adjacent rollers are available to engage the sprockets of FIGS. 2–4.

Figure 9:
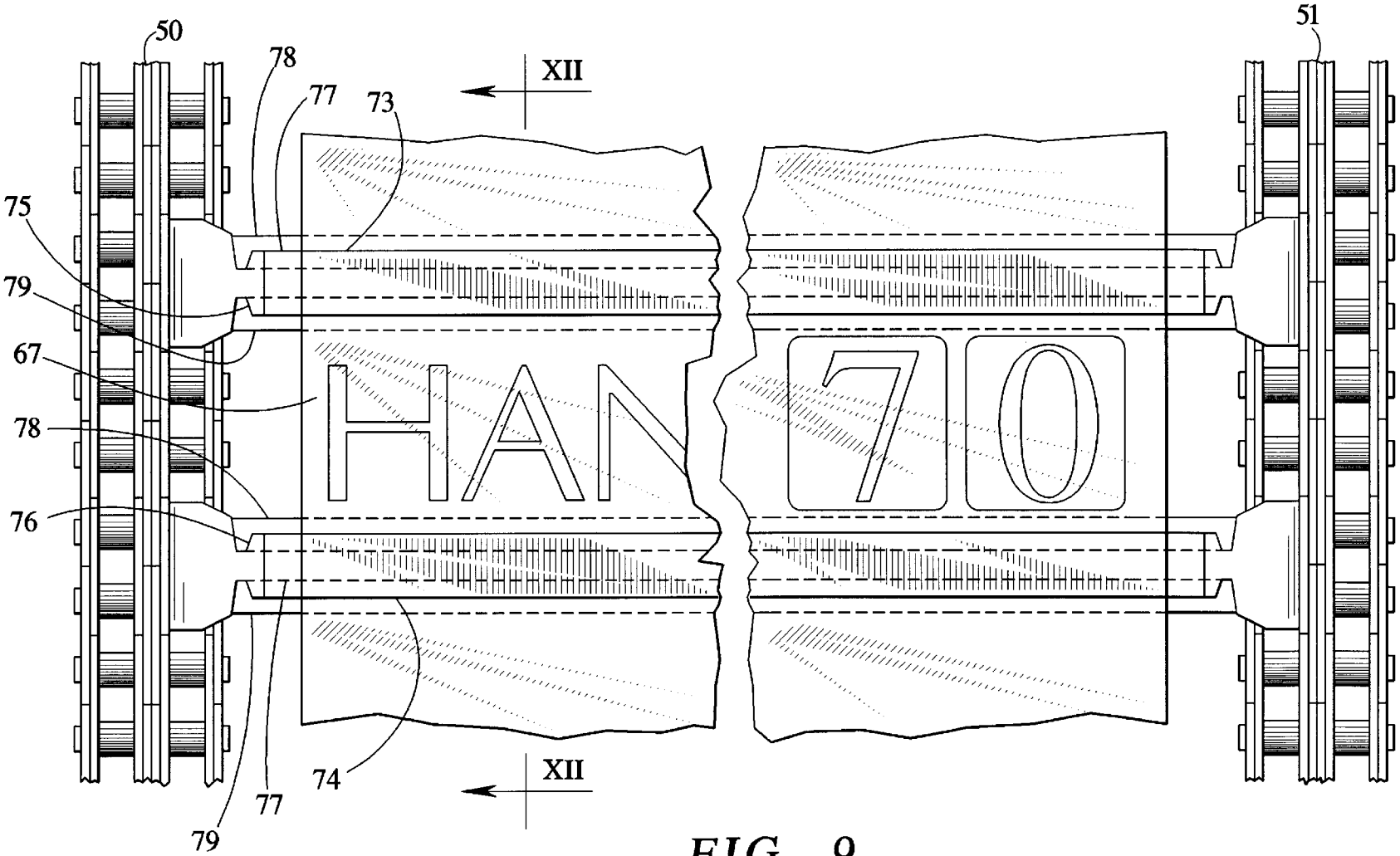
FIG. 9 is an enlarged fragmentary view, similar to FIG. 5, f the roller chains, two slats and a retained information strip.

The mid-section 62 of slat 49 in FIGS. 5–8 is designed to accomplish another object of the present invention, namely, to accept the convenient insertion and removal of message strips like the message strip 67 illustrated in FIG. 9. To accommodate message strips, the mid-section 62 of slat 49 of FIGS. 5–8 is molded into a front surface 68, top back surface 69, and bottom back surface 70, creating two grooved edges 71, 72.

Figure 12:
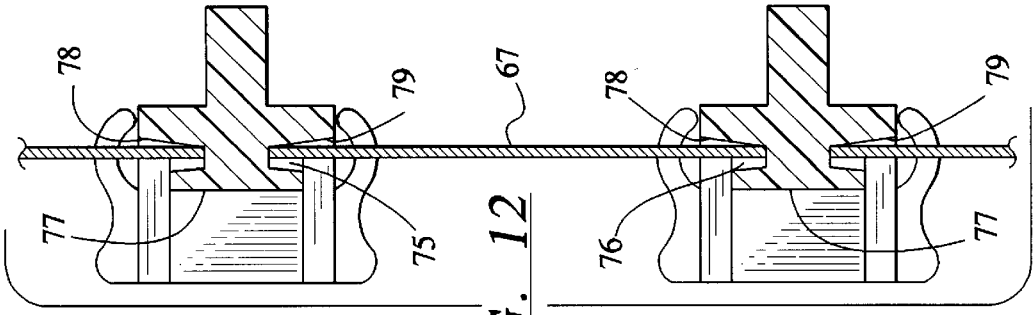
FIG. 12 is a sectional view taken substantially in the plane of line 12—12 of FIG. 9.

Referring now to FIGS. 9 and 12, a message strip 67 is insertable between an upper slat 73 and a lower slat 74 when the slats are attached to the roller chains 50 and 51 and are arranged in parallel relationship. The message strip 67 rests between the grooved edge 75 in slat 73 and the confronting grooved edge 76 in slat 74. The message strip 67 may be exchanged by an operator for another message strip of the same size.

Figure 2:
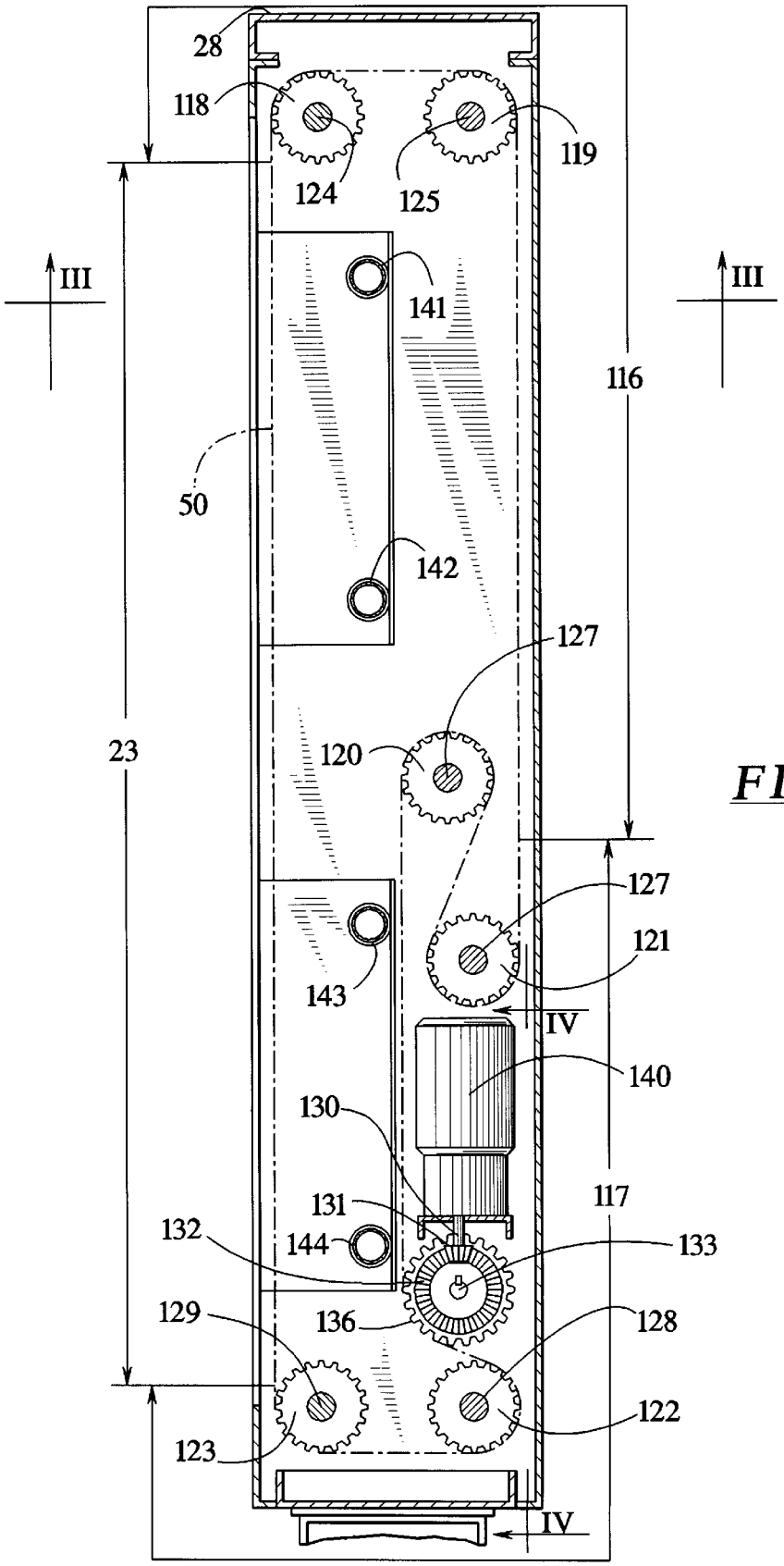
FIG. 2 is a sectional view taken substantially in the plane of line 2—2 of FIG. 1.
Figure 3:
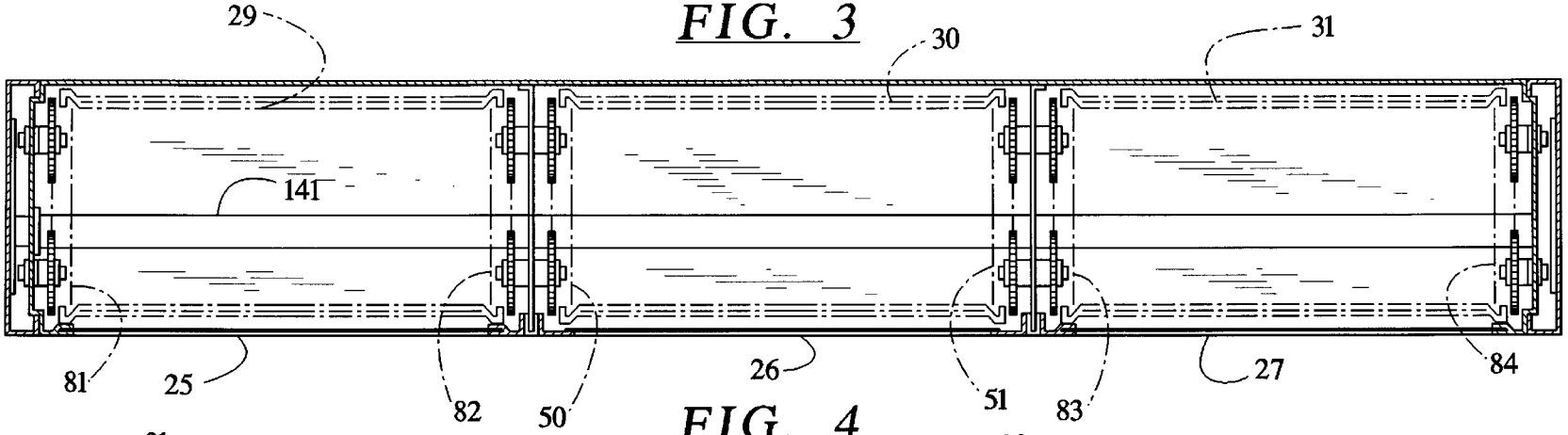
FIG. 3 is a sectional view taken substantially in the plane of line 3—3 of FIG. 2.
Figure 4:
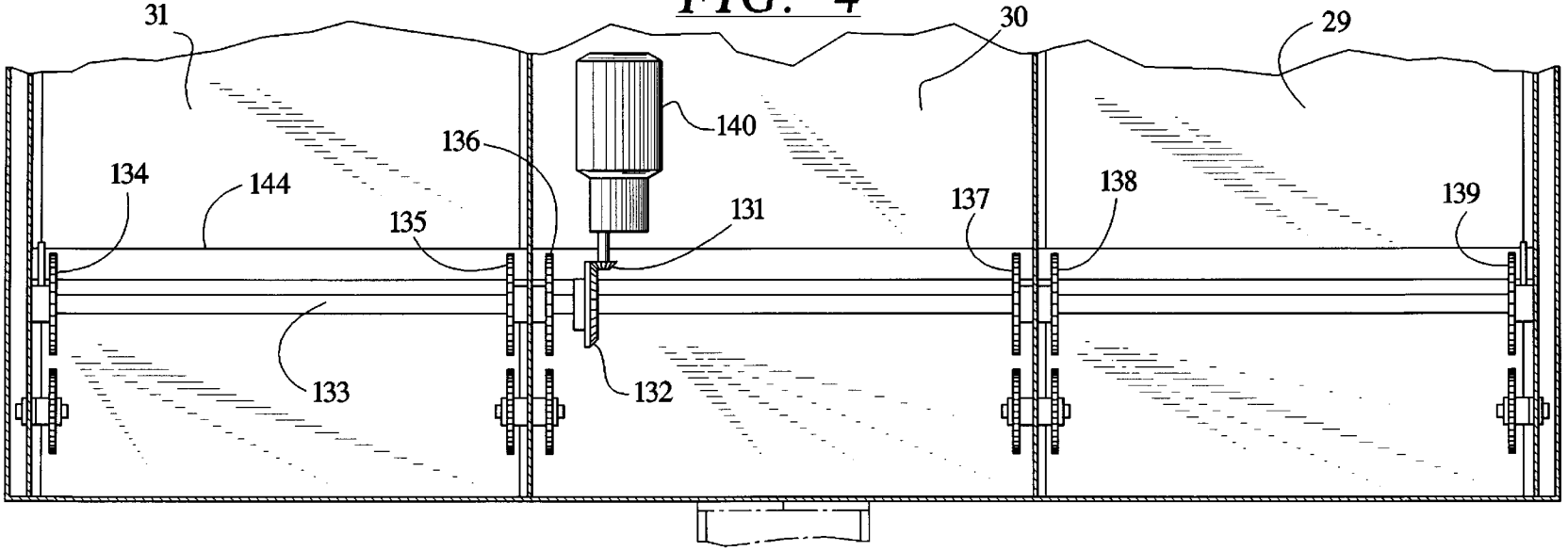
FIG. 4 is a fragmentary sectional view taken substantially in the plane of line 4—4 in FIG. 2.

To permit a message strip 67 (FIGS. 9, 12) to bend but not break, while compelling it to stay engaged by the grooves 75, 76 in its two supporting slats 73, 74, even as those slats travel around the various sprockets of FIGS. 2–4, the front slat surfaces 77 (FIG. 12) (refer also to 68, FIGS. 5–6, 8) are not as wide as the combined back surfaces 78, 79 (FIG. 12) (refer also to 69, 70, FIGS. 5–6, 8).

To keep the slat 49 (FIGS. 5–8) from bending or twisting as it travels along the path dictated by the sprockets and shafts of FIGS. 2–4, a stiffener 80 is provided and is integrally molded to the mid-section 62 and elbows 60, 61 of the slat 49 in FIGS. 8 and 9.

To keep the mid-section 62 of the slat 49 of FIGS. 5–8 aligned with the axes of the rollers 56, 57, and thus to keep the spacing between confronting slat grooved edges constant, e.g. between the edges 75 and 76 in FIGS. 9 and 12, the slat is provided with elbows 60, 61 (FIGS. 5–8) which curve forward from the slat mid-section to meet each end 52, 53. If these elbows did not exist and the slats were permitted to travel forward of this plane, the spacing between confronting grooved edges, e.g. 75 and 76 (FIGS. 9, 12), would increase as the slats traveled around the sprockets of FIGS. 2–4, and message strips, e.g. message strip 67, could become disengaged from the slats. In the event a slat end in accordance with this invention were to be designed to attach at each end to one roller instead of two, the function of the slat elbows would be better described as that of locating the slat mid-section along the extended imaginary axis of the engaged rollers.

To form each rotatable endless roller chain and slat assembly 29–31 (FIGS. 1–4), the present invention contemplates that a plurality of mounting slats, each identical to the slat 49 of FIGS. 5–8, are mounted in spaced parallel relationship on and between the roller chain pairs 50 and 51, 81 and 82, and 83 and 84 of FIG. 3 in the same manner that the slat 49 is mounted on the roller chains 50, 51 in FIG. 5. (In the illustrated embodiment of the invention, the centers of the slats supporting message strips are 1.5 inches apart.) Most of the appropriately spaced mounting slats support message strips like the strip 67 illustrated in FIG. 9 and strips 34–36 of FIG. 1, but blank spacer strips like strips 41–42 in FIG. 1 can be included to provide a neat, finished appearance to the display face. Some of the slats support flexible sheets, e.g. sheets 43, 44, as described in more detail below.

Figure 10:
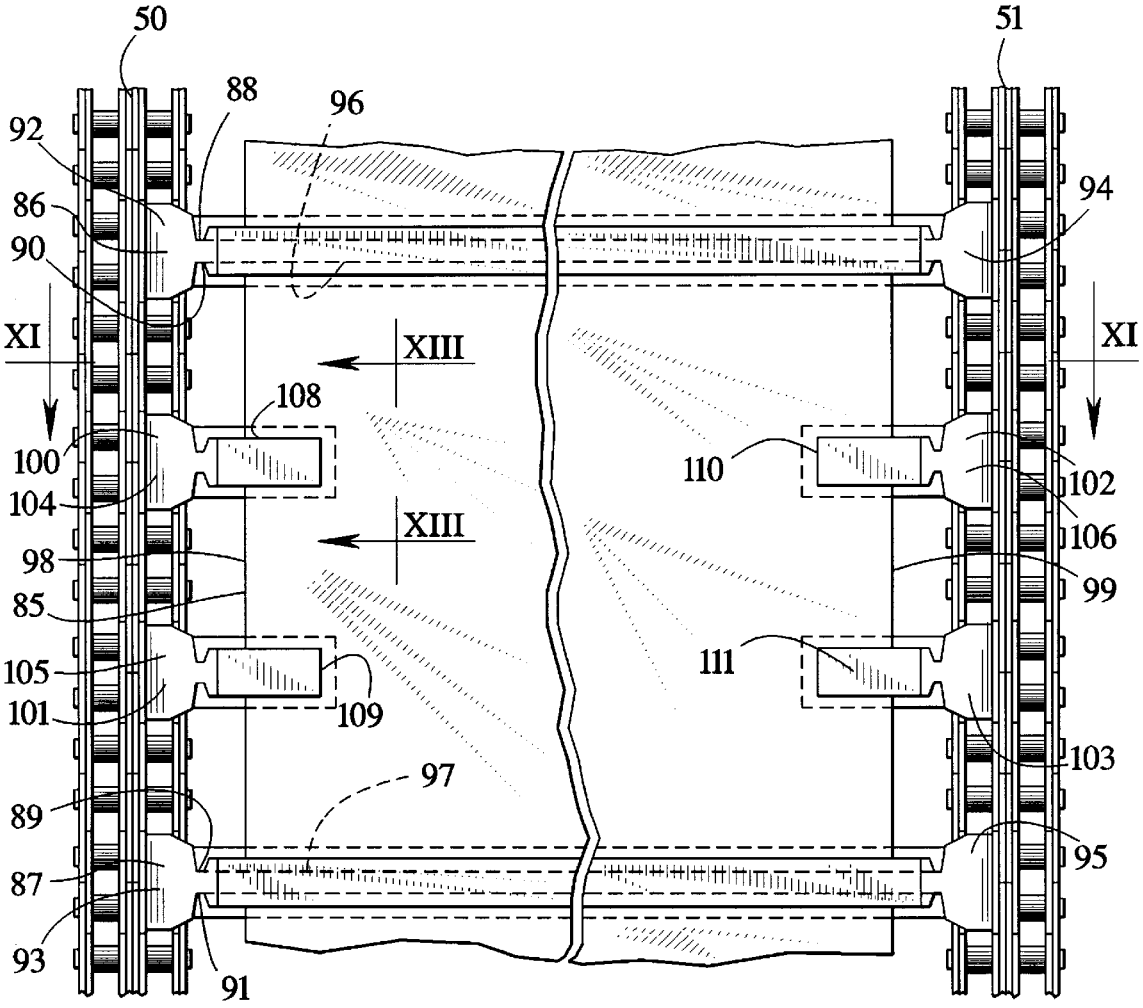
FIG. 10 is a fragmentary view similar to FIG. 9 but showing an elongated picture or information sheet mounted to one of the roller chains by two slats and a series of mounting clips.

Another object of the present invention is to provide means for securely attaching and readily detaching flexible sheets, e.g. sheets 43, 44 in FIG. 1, to or from the roller chains in an endless chain and slat assembly 29–31 (FIGS. 3 and 4), without impairing the smooth operation of the assembly. This object is partially accomplished, with reference to the flexible sheet 85 of FIG. 10, by provision of two slats 86, 87 (FIG. 10), each shaped like the detailed slat 49 of FIG. 5, with grooved edges 88, 89, 90, 91 (FIG. 10). Each slat 86, 87 (FIG. 10) has ends 92, 93 and 94, 95 that are removably connected to roller chains 50, 51 in the manner described in connection with FIGS. 5–8. Further, the slats 86, 87 (FIG. 10) are always separated from each other by a constant distance equal to the length of the flexible sheet, with any intermittent slats removed from the assembly.

It will be noted that the flexible sheet 85 of FIG. 10 has four edges, 96, 97, 98, 99. The first two edges, 96, 97 are perpendicular to the roller chains 50, 51 of FIG. 10, and the second two edges, 98, 99, are located parallel to the roller chains 50, 51 of FIG. 10. The first edge 96 of the flexible sheet 85 is easily and removably inserted into the grooved edge 90 (FIG. 10) of slat 86. The second edge 97 of the flexible sheet 85 is easily and removably inserted into the confronting grooved edge 89 (FIG. 10) of slat 87. The flexible sheet 85 is thus partially supported by and held in its designated place in the slat and roller chain assembly 30 (FIGS. 1–4) by slats 86 and 87 (FIG. 10).

The object of securely but removably attaching a flexible sheet 85 to roller chains 50 and 51 (FIG. 10) is complemented and completed by the provision of mounting clips 100, 101, 102, 103 (FIG. 10). These mounting clips each have one end 104, 105, 106, 107 that is identical to either end of a bi-ended slat, for example, end 52 of slat 49 of FIG. 5. The mounting clip ends are each disposed with two clip hooks, arranged identically to slat hooks 54, 55 (FIGS. 6–8) in order to engage adjacent rollers in roller chains in the same manner as the slat 49 of FIG. 5. As discussed in connection with FIGS. 5–7, each engaged roller has an axially adjacent roller available to engage the sprockets of FIGS. 2–4.

Figure 11:
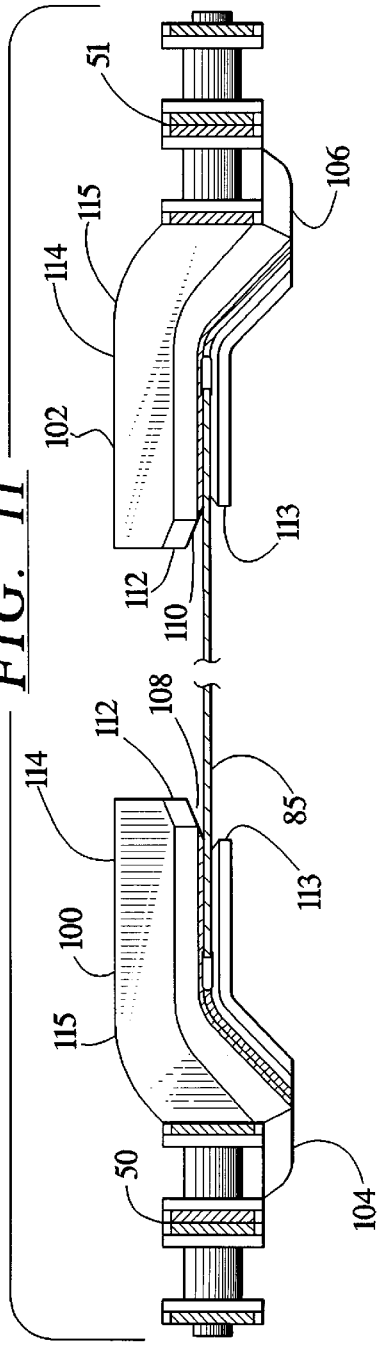
FIG. 11 is a sectional view taken substantially in the plane of line 11—11 of FIG. 10.

In FIG. 11, the ends, 104, 106 of mounting clips 100, 102 are shown engaging roller chains 50 and 51. In order to removably engage and secure the third and fourth edges 98, 99 of the flexible sheet 85 of FIG. 10, the mounting clips 100–103 are provided with sheet-retaining edges, specifically, grooved edges 108, 109, 110, 111 (FIG. 10).

Figure 13:
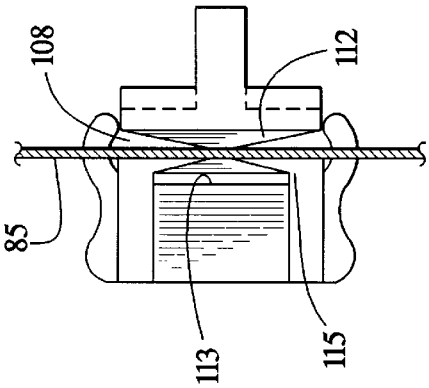
FIG. 13 is a sectional view taken substantially in the plane of line 13—13 of FIG. 10.

In FIGS. 11 and 13, mounting clips 100, 102 are shown engaging the flexible sheet 85 of FIGS. 10–13 in the sheet-retaining edges of the clips 108, 110. In the illustrated embodiment of the invention, the sheet-retaining edges are grooved. Mounting clip edge 108 is shown engaging the flexible sheet 85 in FIG. 13. To securely support a flexible sheet, the mounting clips in the illustrated embodiment are designed with a longer back surface 112 than front surface 113 (FIGS. 11, 13). In order to keep the mounting clips from twisting or bending, a stiffener 114 is disposed on the back surface 112 of each clip (FIGS. 11, 13).

In order to avoid stretching the flexible sheet of FIGS. 10–11 and 13 supported by mounting clips 100–103 in a roller chain and slat assembly 30, it is necessary to maintain a constant distance between the mounting clips, or between the mounting clips and slats, as they travel around sprockets like those described in connection with FIGS. 2–4. (A similar concept was described in connection with bi-ended slats 49 and 73, 74, in FIGS. 5, 9.) To maintain such a constant distance, it is generally necessary to shape the mounting clips so that the edges which retain a flexible sheet are aligned with the axes of the rollers on the roller chain that are engaged by the ends of the mounting clips. For this purpose, an elbow is an integrally formed part of each mounting clip. With reference to the mounting clip 100 in FIGS. 11 and 13, the elbow 115 connects the sheet-retaining edge 108 to the end 104. In the event a clip end in accordance with this invention were to be designed to attach at its end to one roller instead of two as illustrated herein, the function of the slat elbows would be better described as that of locating the clip edge along the extended imaginary axis of the engaged roller.

It is generally expected, but not required, that mounting clips will be used in pairs like those shown in FIGS. 10 and 11. As many mounting clips as desired may be used to support any one flexible sheet, limited only by the physical number of rollers available on the pertinent roller chains.

Thus, with reference to FIG. 10, the object of detachably securing a flexible sheet in a slat and roller chain assembly is fully achieved by the use of mounting slats 86, 87 at the first and second edges 96, 97 of the flexible sheet 85, and by the use of mounting clips 100–103 along the third and fourth edges 98, 99 of the flexible sheet as needed.

Still another object of the present invention is to provide a rotatable sign which permits the arrangement or rearrangement of the individual display faces 23, 116, and 117 of FIG. 2 (and display faces 22–24 of FIG. 1) by the ready exchange of several message strips for a flexible sheet. In the illustrated embodiment of the invention, these display faces are each a portion of a different menu. The unique structure of the slat 49 illustrated in FIGS. 5–8 and the mounting clips 107, 107 of FIGS. 11 and 13 as described herein make this novel exchange possible.

As described in connection with FIGS. 5–8, the mounting slats are designed to easily attach to and detach from rollers on roller chains. Thus, if it is desired to replace several message strips with, e.g., a P.O.P. picture imprinted on a flexible sheet, an operator would simply remove the appropriate message strips from their positions between slats (e.g. strip 67 in FIG. 9, or strips 34–36 in FIG. 1), and then remove the empty slats from the slat and chain assembly by disengaging the hooks (e.g. 54, 55 in FIG. 7) at the slat ends (e.g. 52, 53 in FIG. 5). The operator would leave two slats appropriately spaced (e.g. slats 86, 87 in FIG. 10) to support the first and second edges of the picture, e.g., the top and bottom edges of sheet 85 in FIG. 10. Mounting clips (e.g. clips 100–103 in FIG. 10) would then be mounted on appropriate rollers on the roller chains to engage and support the picture at its remaining edges. In FIG. 10, two slats and three message strips would have been removed from the sign assembly, between remaining slats 80 and 81, in order to make room for the flexible sheet 85.

It is yet another object of the present invention to provide a sign assembly that permits expedient switching among several different displays, which are, in this embodiment of the invention, menus. This object is accomplished by the structure illustrated in FIGS. 1–4.

Each of the roller chains 50, 51, 81, 82, 83 and 84 of FIG. 3 engages a set of sprockets arranged substantially like the sprockets 118, 119, 120, 121, 122, 123 of FIG. 2. Each sprocket is engaged by a sprocket mounting shaft in the same manner in which the sprockets 118–123 are engaged by shafts 124, 125, 126, 127, 128, 129 in FIG. 2. The sprocket mounting shafts are mounted on the various interior walls of the cabinet 28.

Slats as described herein in connection with FIGS. 5–9 and FIG. 12 are connected between pairs of roller chains 50 and 51, 81 and 82, 83 and 84 (FIG. 2) creating three endless roller chain and slat assemblies 29–31 (FIGS. 1–4). Each assembly thus has two sets of standard sprockets and mounting shafts arranged identically to sprockets 118–123 and shafts 124–129 of FIG. 2.

All of the mounting shafts and sprockets engaged by roller chains 50, 51, 81, 82, 83 and 84 (FIG. 3) are driven to rotate by the drive assembly 130, comprised of a bevel drive pinion 131, a bevel drive gear 132, a drive shaft 133 and drive sprockets 134, 135, 136, 137, 138, 139 (FIG. 4). The drive assembly is powered by the motor 140 (FIGS. 2, 4), which rotates the bevel drive pinion 131, which pinion in turn engages and rotates the bevel drive gear 132. The drive gear engages and rotates drive shaft 133, turning drive sprockets 134–139 and thus simultaneously pulling all of the roller chains 50, 51, 81, 82, 83 and 84 (FIG. 2), as well as rotating the mounting shafts and sprockets engaged by each chain, as described above.

At least two additional display faces, similar to the additional faces 116, 117 in FIG. 2 (also similar to visible display faces 22–24 in FIG. 1) are available for each roller chain and slat assembly 29–31. These additional display faces are stored on the portions of the roller chain and slat assemblies 29–31, that are positioned in the cabinet away from the windows 25–27. They cannot be viewed through the windows 25–27 until they are each pulled into view as described above. With reference to FIG. 2, the portion of the roller chain and slat assembly 30 that stores the additional display faces 116, 117 is located substantially to the right of the two leftmost sprockets 118 and 123. When it is desirable to change the display faces, the motor is activated, powering drive assembly 130. The drive shaft and sprockets rotate, inducing all of the sprockets and mounting shafts in each of the assemblies 29–31 to rotate. The result is that all three parallel display faces 22–24 of the present invention are simultaneously rotated to a storage position, while three previously stored display faces, e.g. additional display face 116 in FIG. 2, become visible through the cabinet windows. When the new display faces are in place, the motor power may be disengaged. It is contemplated that the motor may be stopped and started at appropriate points by a trip-stop switch, where the switch is engaged by fingers provided on the roller chains, or by connection of the motor to one or more timers, or by provision of a remote switch for the motor for use by an operator located indoors.

In another embodiment of the present invention, rotation of the drive assembly and thus of the display faces is accomplished by means of a hand crank instead of a motor.

In the illustrated embodiment of the invention, the rotatable sign 21 may be illuminated when desired by powering light fixtures 141, 142, 143, 144 (FIGS. 2–4). The fixtures provided may be neon, fluorescent, or the like.

Figure 15:
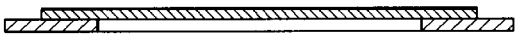
FIG. 15 is a sectional view taken substantially in the plane of line 15—15 of FIG. 14.
Figure 14:
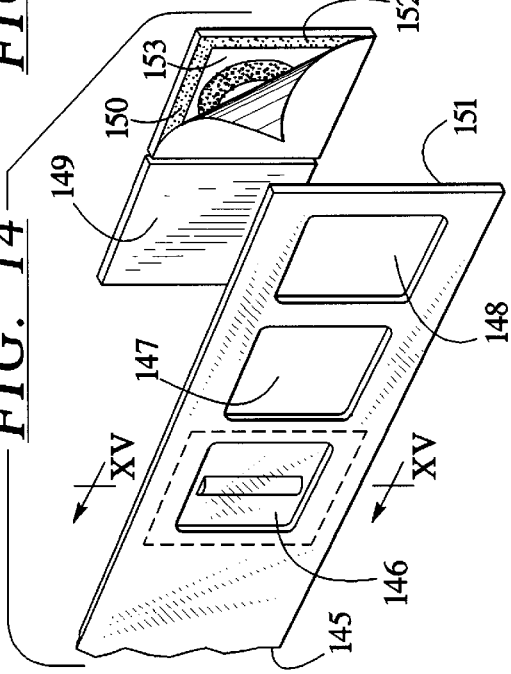
FIG. 14 is an exploded view of a message strip and associated price numerals.

Still another object of the present invention is to provide an attractive message strip that has a price display that may be easily and routinely changed by means of a self-stick adhesive material. This object is accomplished by the structure illustrated in FIGS. 14 and 15. To display and change the price of a menu item, message strip 145 is provided with three openings 146, 147, 148. Stickers 149, 150, imprinted with any of digits zero through nine, may be adhered to the back surface 151 of message strip 145. To position sticker 150 so that its imprinted digit is visible, through an opening 146, 147, or 148, to someone viewing the message strip 145, a frame of adhesive 152 is disposed around the edge of the front surface 153 of the sticker 150. It is contemplated that multiple stickers similar to sticker 150 will be available for use with message strips in accordance with the invention.

We claim:

1. A sign comprising: a slat; and at least two double row roller chains; where said slat has a mid-section, two ends and two elbows; where said slat mid-section has at least two edges, each with a grooved opening for receiving a flexible sheet or strip; where each of said slat ends is shaped to removably engage at least a first roller in each of said roller chains; where a second roller of each chain is axially adjacent to said first roller, and is available to be engaged by a sprocket; and where each slat elbow is positioned between each of said slat ends and said slat mid-section, and each of said elbows curves forward from the mid-section a predetermined distance to meet said ends, and said elbows locate said slat mid-section along an extended imaginary axis of said engaged roller chain rollers when said slat ends engage said rollers.

2. A sign as defined in claim 1, wherein said slat comprises integrally molded plastic.

3. A sign as defined in claim 1, comprising a plurality of slats removably engaged on said roller chains.

4. A sign comprising at least first and second spaced apart double row roller chains and a slat including a slat mid-section and two opposed ends, the slat mid-section including at least two edges, each edge having a grooved opening for receiving a flexible sheet or strip and the grooved openings of the edges being opposite facing, each slat end being configured to removably engage at least one roller in a said roller chain and the slat being engaged at its ends to at least a first roller of the first roller chain and the second roller chain, respectively, a second roller of said first and said second roller chains axially adjacent to said first rollers being available to be engaged by a sprocket, said slat further including an elbow positioned between each slat end and the slat mid-section, each elbow being curved forwardly from the slat mid-section a predetermined distance to meet said ends, such that the elbows locate the slat mid-section along an extended imaginary axis of said engaged first rollers on said first and second roller chains.

5. A sign as defined in claim 4, wherein each slat end includes at least one pair of slat hooks effective to cooperatively releasably engage a first roller.

6. A sign as defined in claim 4 wherein said slat comprises integrally molded plastic.

7. A sign as defined in claim 4 comprising a plurality of slats removably engaged on said first and second roller chains.

* * * * *